US006209661B1

(12) United States Patent
Muona

(10) Patent No.: US 6,209,661 B1
(45) Date of Patent: Apr. 3, 2001

(54) METHOD AND ARRANGEMENT FOR CONTROLLING FEED IN ROCK DRILLING

(75) Inventor: Jouko Muona, Siuro (FI)

(73) Assignee: Sandvik Tamrock Oy, Tampere (FI)

( * ) Notice: Subject to any disclaimer, the term of this patent is extended or adjusted under 35 U.S.C. 154(b) by 0 days.

(21) Appl. No.: 09/308,359

(22) PCT Filed: Nov. 26, 1997

(86) PCT No.: PCT/FI97/00726

§ 371 Date: May 18, 1999

§ 102(e) Date: May 18, 1999

(87) PCT Pub. No.: WO98/23848

PCT Pub. Date: Jun. 4, 1998

(30) Foreign Application Priority Data

Nov. 27, 1996 (FI) ..... 964736

(51) Int. Cl.[7] ..... E21B 44/00; E21C 5/00

(52) U.S. Cl. ..... 175/25; 173/1; 173/158

(58) Field of Search ..... 175/25; 173/4, 173/8, 1, 9, 11, 157, 158; 91/170 R, 189, 31; 60/719

(56) References Cited

U.S. PATENT DOCUMENTS 3,561,542 2/1971 Hanson et al. .
4,271,914 6/1981 Dressel .
4,275,793 6/1981 Schivley, Jr. et al. .

FOREIGN PATENT DOCUMENTS 1118766 10/1984 (RU) .
95/28549 10/1995 (WO) .

*Primary Examiner*—Robert E. Pezzuto
(74) *Attorney, Agent, or Firm*—Smith-Hill and Bedell

(57) ABSTRACT

A method and an arrangement for controlling the feed of a rock drill. In the method, the pressure in a pressure conduit (7*a*) of a pressure-fluid-operated feed motor (6) is measured, and when the pressure value measured is below the pre-set threshold value, the volume flow of the pressure fluid delivered to the feed motor and thereby the feed rate of the feed motor (6) are adjusted, and when the pressure value measured is above the pre-set threshold value, the feed is adjusted by adjusting the pressure of the pressure fluid delivered to the feed motor (6). In the arrangement, a pressure detector (13) is arranged in the pressure conduit (7*a*) of the feed motor (6). The detector is arranged to control the feed of the pressure fluid delivered to the feed motor (6) in such a way that when the pressure is below the pre-set threshold value, the feed is controlled by adjusting the volume flow of the pressure fluid and, correspondingly, when the pressure value is above the pre-set threshold value, the pressure detector adjusts the feed of the pressure fluid according to the pressure of the pressure fluid.

5 Claims, 1 Drawing Sheet

METHOD AND ARRANGEMENT FOR CONTROLLING FEED IN ROCK DRILLING

BACKGROUND OF THE INVENTION

The invention relates to a method for controlling the feed of a pressure-fluid-operated rock drilling apparatus when a rock drill is fed forward by a pressure-fluid-operated feed motor.

The invention further relates to an arrangement for controlling the feed of a pressure-fluid-operated rock drilling apparatus comprising a rock drill, a feed beam along which the rock drill moves, a pressure-fluid-operated feed motor for moving the rock drill along the feed beam, control means for adjusting the feed of the rock drill, and means for adjusting the flow of the pressure fluid and thereby the feed rate of the feed motor.

The aim in rock drilling is on the one hand to control the entire drilling operation such that ineffective time can be minimized and on the other hand to conduct the actual drilling operation such that a hole can be drilled as close to the desired position as possible, while the apparatus is subjected to as little wear and damage as possible. In practice, the impact and rotation parameters and the feed of the rock drill in today's rock drilling apparatus can be adjusted by different controls. In practice, solutions widely used are the ones in which the drilling power is adjusted and an automatic control adjusts both impact and feed pressure in accordance with pre-set control parameters. Because the rock to be drilled and the drilling situations vary, there usually also exists a separate manual feed control system by which the feed pressure can be deflected from the pressure defined by the parameters, so that the drilling operation can also be adjusted in accordance with the conditions. In connection with collaring, or before the actual drilling is started, it is, however, difficult to adjust the drilling operation by adjusting the pressure of the feed, since the feed pressure does not take into account, for example, the effect of an inclined surface on the motion of the drill bit and on the bending of the drill rod, and the drilling step is therefore not very easy to adjust at present. The position of the feed apparatus and various friction factors in the feed apparatus as such make it impossible to accurately control the collaring step and the moving of the drill bit to the rock surface with one and the same pressure value.

SUMMARY OF THE INVENTION

The object of the present invention is to provide such a method and arrangement for controlling the feed in rock drilling that the rock drilling operation can be better adjusted, if desired, in the collaring step and also during the actual drilling under exceptional conditions.

The method of the invention is characterized in that at least in the collaring step the pressure of the pressure fluid in a pressure conduit of the feed motor is measured, that when the pressure of the pressure fluid is below a pre-set threshold value, the volume flow of the pressure fluid delivered to the feed motor is adjusted so as to adjust the feed rate, and that when the pressure of the pressure fluid is above said pre-set threshold value, the feed is controlled by adjusting the pressure of the pressure fluid delivered to the feed motor.

The arrangement of the invention is characterized in that the arrangement comprises a pressure detector that is arranged to detect the pressure of the pressure fluid in the pressure conduit of the feed motor; and that the pressure detector is arranged to control the control means in such a way that when the pressure in the pressure conduit of the feed motor is below a pre-set threshold value at least in the collaring step, the control means are arranged to adjust the volume flow of the pressure fluid and thereby the feed rate of the feed motor, and that when the pressure in the pressure conduit of the feed motor is above the value pre-set for the pressure detector, the control means are arranged to control the pressure of the pressure fluid in the pressure conduit of the feed motor.

The essential idea of the invention is that when the drill bit is moved toward the rock in the collaring step, the feed rate at which the drill bit moves toward the rock is adjusted. If, for example, the surface is inclined, the feed rate at the beginning of the drilling operation can be adjusted to be low, so that the collaring will not bend nor incline the drill apparatus, which is what would happen if the feed pressure were adjusted. Another essential idea of the invention is that when a proper rock contact has been established so that there is no risk of bending or inclining, the feed control automatically switches to normal feed pressure, and from then on the drilling operation is conducted under the control of normal drilling parameters.

The advantage of the invention is that the rock contact can be established and the collaring conducted accurately and carefully by adjusting of feed rate, whereby the drilling is simple and easy for the user to control. Correspondingly, if the drill bit is in firm contact with the rock to be drilled, normal drilling, where the adjustment is based on the adjustment of pressure, is safe to use. In this way, the drilling control is comfortable and operatively logical for the user to control. The method of the invention helps to avoid mispositioning of drill holes, and faults in the machinery, and simultaneously makes the apparatus easier to use.

BRIEF DESCRIPTION OF THE DRAWINGS

The invention will be described in greater detail in th) attached drawings, in which.

DESCRIPTION OF THE PREFERRED EMBODIMENT

Figure 1:
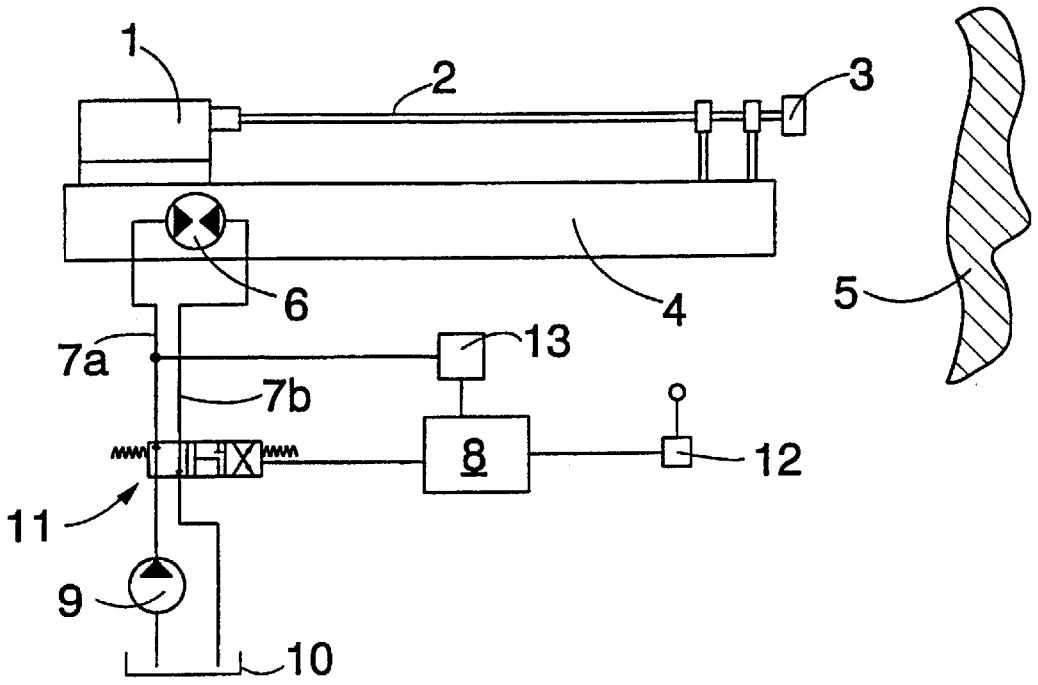
FIG. 1 is a schematic view of an embodiment of an arrangement according to the invention in a rock drilling apparatus.

FIG. 1 is a schematic view of an embodiment of an arrangement according to the invention in a rock drilling apparatus. The arrangement comprises a rock drill 1 to which is connected a drill rod 2 and a drill bit 3 at the end of the drill rod 2. The rock drill 1 is arranged to move along a feed beam 4 in the longitudinal direction toward the front end of the feed beam 4 during the drilling. In the collaring step, the feed beam 4 is first moved toward rock 5, after which the rock drill 1 is moved forward.

The rock drill 1 is nowadays usually operated hydraulically: pressure fluid is supplied to the rock drill through pressure fluid conduits or, usually, hoses. For the sake of clarity, only pressure conduits 7*a* and 7*b* connected to a feed motor 6 are shown in the figure. The pressure fluid is delivered through conduit 7*a* to the feed motor so as to move the rock drill 1 in the drilling direction, and the returning pressure fluid is discharged through conduit 7*b*. The return motion is effected normally by cross-connecting the conduits. As regards the operation, the feed of the pressure fluid is controlled by control means, which include a separate control unit 8 adjusting the amount of pressure fluid in different hoses and, correspondingly, the pressure in each hose in accordance with pre-set manually adjusted parameters. The pressure fluid is supplied in a manner known per se by a pressure fluid pump 9, and the pressure fluid will return to a pressure fluid container 10. The pump and the container are commonly known, so they will not be described in greater detail herein.

The figure shows a schematic view of a feed motor 6, indicated by a symbol, which is a hydraulic motor or a hydraulic cylinder. Both a hydraulic motor and a hydraulic cylinder operate as a feed motor that is arranged in a manner known per se to move the rock drill 1 in both directions lengthwise of the feed beam 4. The transfer mechanisms and connections are commonly known per se, and so they will not be described in greater detail herein. Pressure fluid conduit 7*a* is arranged to supply fluid to the feed motor 6, i.e. a pressure fluid hose is arranged to be controlled such that the feed of the pressure fluid is controlled by a feed adjustment valve 11. The volume flow of the pressure fluid flowing through the adjustment valve is dependent on the position of a manual feed control 12. The feed rate can be given a certain commonly used nominal value, which can be raised or reduced by means of the feed control 12 according to the need. Further, a pressure detector 13 is connected to pressure fluid conduit 7*a* of the feed motor, the detector detecting when the drill bit 3 hits the rock, so that the feed resistance increases. At a suitable feed rate, the drill bit can machine the rock gradually, for example, in an inclined rock surface without that the feed pressure exceeds the set value of the pressure detector 13. The low feed rate can be employed until an essentially full-size drill surface has been achieved for the drill bit, after which the pressure continues to rise. As the pressure detector 13 detects that the threshold pressure has been exceeded, the feed control 12 begins to control the feed pressure in pressure fluid conduit 7*a* through the feed control valve 11. The feed pressure then settles at the level defined by the parameters of the control unit 8, and it can be deflected from that level in either direction by the feed control 12. In practice, as the pressure detector 13 detects that a proper rock contact has been established, the drilling operation, controlled by the control unit 8, switches to normal sequence drilling operation, and the drilling steps are then automatically conducted in the desired manner.

If, for some reason, the material being drilled comprises broken rock or hollow spaces, the feed pressure easily drops below the threshold value of the pressure detector 13. The pressure detector 13 can then make the apparatus control the feed rate rather than the feed pressure by switching the feed control 12 to control the volume flow of the feed control valve 11 rather than the pressure. Correspondingly, when the point causing little resistance has been passed and the drill bit 3 has hit the hard surface, the pressure detector 13 re-switches the feed to operate in accordance with the pressure.

Figure 2:
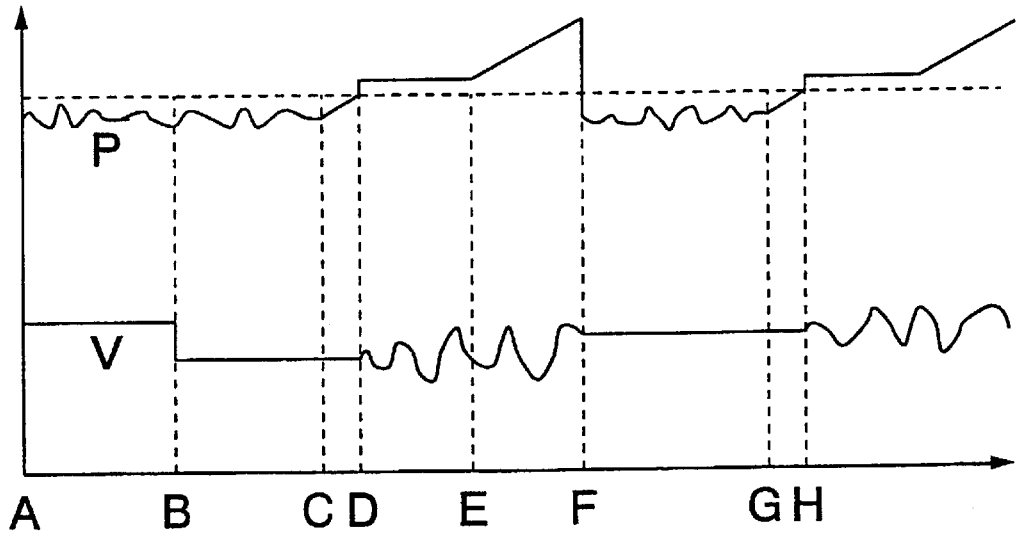
FIG. 2 is a schematic view of rate and pressure curves during drilling, obtained by using the arrangement according to the invention.

FIG. 2 shows a schematic view of how the feed pressure and feed rate of an embodiment of a rock drilling apparatus according to FIG. 1 vary in different drilling situations. Curve V in the figure indicates the feed rate, and curve P indicates the pressure of the pressure fluid in the feed motor.

At point A on the left in the figure, the feed beam is in the collaring position. Up to point P on the right, curve V indicates how the rate of the feed motor remains constant, whereas the feed pressure varies slightly, since the friction factors, etc. change the feed resistance of the feed motor. At point B the user slows down the feed rate, which drops but remains essentially constant after the slow-down up to point C, while the feed pressure continues to vary to some extent. At point C the drill bit comes into contact with the rock surface and the feed pressure begins to rise, while the feed rate remains essentially the same. At point D the feed pressure value exceeds the pre-set threshold value of the pressure detector 13, and the feed pressure settles at a suitable pressure level for the actual collaring, remaining essentially constant at that level, while the feed rate begins to vary. In this step at the latest, the impact operation of the rock drill is switched on, although in principle it can have been operative all the time from point A onward. At point E the collaring step is over, and the feed pressure begins to rise in a predefined manner, and the feed rate will vary with the drilling resistance. The feed pressure, in turn, controls the impact and rotation operations of the rock drill in a suitable manner known per se.

As the drill hits softer or broken rock or a hollow space, the feed pressure drops suddenly at point F, and as it drops below the pre-set threshold value of the pressure detector 13, the pressure detector begins to control the drilling by adjusting the feed rate rather than the pressure. From point F to point G, the feed rate thus remains essentially constant, and the feed pressure varies with the conditions. At point G the feed pressure starts to rise again because the rock material is firmer and harder, and at point H the pressure exceeds the pre-set threshold value of the pressure detector 13, after which the drilling control begins to operate on the basis of the feed pressure in the manner described above, while the feed rate starts to vary.

In the above description and the drawings, the invention is described by way of an example, and it is not to be construed as being limited by them. The essential feature is that the drilling control is implemented by controlling the feed as the drill moves toward the rock and, if necessary, by adjusting the feed rate under conditions where there is little feed resistance, and during the actual drilling the same feed control is switched to control the feed pressure instead of the feed rate. The other drilling steps can be implemented in different previously known ways and by different sequence drillings in accordance with pre-set definitions.

What is claimed is:

1. A method of controlling a rock drilling apparatus that includes a rock drill, a pressure-fluid operated feed motor for feeding the rock drill forward, and a pressure conduit for supplying pressure fluid to the feed motor, said method comprising, during a collaring step:

supplying pressure fluid to the feed motor via the pressure conduit, comparing the pressure of the pressure fluid in the pressure conduit with a pre-set threshold value, when the pressure of the pressure fluid in the pressure conduit is below the pre-set threshold value, controlling the feed rate by adjusting the volume flow of pressure fluid delivered to the motor, and when the pressure of the pressure fluid in the pressure conduit is above the pre-set threshold value, controlling the feed rate by adjusting the pressure of pressure fluid delivered to the motor.

2. A method according to claim 1, comprising continuing to compare the pressure of the pressure fluid in the pressure conduit with the pre-set threshold value during drilling and, in the event that the pressure of the pressure fluid in the pressure conduit falls below the pre-set threshold value, adjusting the volume flow of pressure fluid to control the feed rate, and when the pressure of the pressure fluid in the pressure conduit increases once more above the pre-set threshold value, adjusting the pressure of the pressure fluid to control the feed rate.

3. A method of controlling a rock drilling apparatus that includes a rock drill, a pressure-fluid operated feed motor for feeding the rock drill forward, and a pressure conduit for supplying pressure fluid to the feed motor, said method comprising:

supplying pressure fluid to the feed motor via the pressure conduit, comparing the pressure of the pressure fluid in the pressure conduit with a pre-set threshold value, when the pressure of the pressure fluid in the pressure conduit is below the threshold value, controlling the feed rate by adjusting the volume flow of pressure fluid delivered to the motor, and when the pressure of the pressure fluid in the pressure conduit is above the threshold value, controlling the feed rate by adjusting the pressure of pressure fluid delivered to the motor.

4. A rock drill apparatus including:

a rock drill, a feed beam on which the rock drill is mounted for feeding movement, a pressure-fluid operated feed motor for moving the rock drill along the feed beam, a pressure conduit for feeding pressure fluid to the feed motor, a pressure detector for detecting the pressure of pressure fluid in the pressure conduit, and a control means responsive to the pressure detector for controlling supply of the pressure fluid to the feed motor in a manner such that when the pressure of the pressure fluid in the pressure conduit is below a preset threshold value, the control means controls the feed rate by adjusting the volume flow of pressure fluid delivered to the motor, and when the pressure of the pressure fluid in the pressure conduit is above the pre-set threshold value, the control means controls the feed rate by adjusting the pressure of pressure fluid delivered to the motor.

5. A rock drill apparatus according to claim 4, comprising a manual control for controlling supply of the pressure fluid to the feed motor.

* * * * *